US006938871B1

(12) United States Patent
Carlson

(10) Patent No.: US 6,938,871 B1
(45) Date of Patent: Sep. 6, 2005

(54) FLAG OR UMBRELLA SUPPORT POLE

(76) Inventor: Warren Merrill Carlson, 1910 Monterey Ave., Merritt Island, FL (US) 32952

( * ) Notice: Subject to any disclaimer, the term of this patent is extended or adjusted under 35 U.S.C. 154(b) by 0 days.

(21) Appl. No.: 10/831,714

(22) Filed: Apr. 26, 2004

(51) Int. Cl.[7] ..... G09F 17/00
(52) U.S. Cl. ..... 248/519; 248/530; 248/539; 40/607.1
(58) Field of Search ..... 248/514, 518, 248/519, 529, 530, 539; 40/607.01, 607.03, 40/607.04, 607.1; 160/46; 52/155, 156, 157, 52/165, 298; 135/118

(56) References Cited

U.S. PATENT DOCUMENTS 4,079,559 A * 3/1978 Tenbrummeler ..... 52/295
4,402,166 A * 9/1983 Wortham, Jr. ..... 52/155
4,441,679 A * 4/1984 Calet ..... 248/156
4,717,110 A * 1/1988 Fohrman ..... 248/545
4,920,681 A * 5/1990 Toliver et al. ..... 43/21.2
4,923,157 A * 5/1990 Belamiza ..... 248/188.2
5,568,909 A * 10/1996 Timko ..... 248/519
5,634,482 A * 6/1997 Martin ..... 135/16
6,003,826 A * 12/1999 Galloway, III ..... 248/519
6,092,342 A * 7/2000 Sharapata ..... 52/298
2003/0121223 A1 * 7/2003 Riker ..... 52/296

* cited by examiner

*Primary Examiner*—Jonathon Szumny

(57) ABSTRACT

A novel support pole design that is both stable and easily removable in an outdoor environment. The support pole is universally adaptable for use with flags, umbrellas, or other objects requiring support to an elevated position relative to the ground. A key feature of the present invention is the means that anchors the present invention to the ground. This means includes a small locking pin that maintains a large flat base in close coupling with the ground.

1 Claim, 3 Drawing Sheets

FLAG OR UMBRELLA SUPPORT POLE

BACKGROUND OF THE INVENTION

1. Field of the Invention

The present invention relates to the field of support poles or similar devices used for the display of flag-like objects or umbrellas in an outdoor environment.

2. Description of the Prior Art

It is well known in the prior art to use a pole or other extension in order to display a decorative object, such as a flag, or, alternatively, to provide a support means for an elevated object such as a sun umbrella. The simplest of such forms is no more than a straight shaft that is attached to the flag or umbrella at a first, upper end by mechanical means such as a threaded coupling, ropes, or the like. The second, lower end of the straight shaft is driven into the ground and held in place by the rigidity of the ground surrounding the shaft. This second end may taper to a point in order to facilitate entry into the ground. The prior art support pole does not, however, provide a very stable attachment to the ground. Even a moderate breeze exerts a significant force upon the flag or umbrella, which being attached at some distance from the ground, exerts a torque on the ground attachment point. This torque is often sufficient to 'uproot' the second end of the support pole from the ground.

A second prior art design, which is usable both indoors and outdoors, relies upon a heavy, flat-bottomed weight attached to the second end of the prior art support shaft. Such a weight does an admirable job of maintaining the support shaft in the desired upright orientation indoors, but outdoors the weight is unsuccessful in counteracting the torque imposed by a breeze and the support pole again falls to the ground. If the weight is greatly increased, some success can be obtained, however a very heavy weight is cumbersome and not easily translocated as may be desired with a sun umbrella.

SUMMARY OF THE INVENTION

The present invention is a novel support pole design that is both stable and easily removable in an outdoor environment. The support pole is universally adaptable for use with flags, umbrellas, or other objects requiring support to an elevated position relative to the ground.

A key feature of the present invention is the means that anchors the present invention to the ground. This means includes a small wedging shaft that maintains a large flat base in close coupling with the ground.

DETAILED DESCRIPTION OF THE INVENTION

Figure 1:
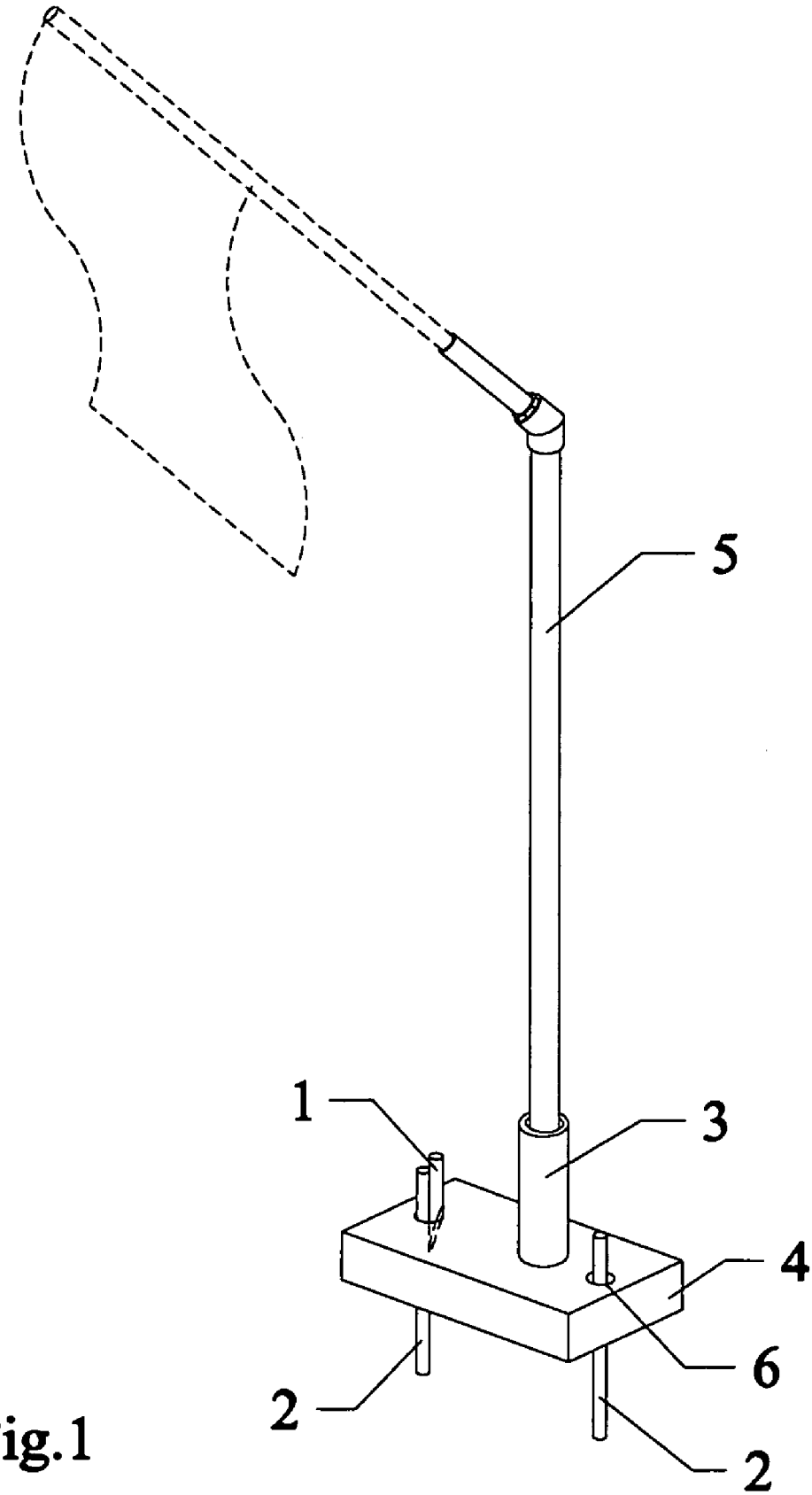
FIG. 1 shows an oblique view of the invention used as a flag support.
Figure 2:
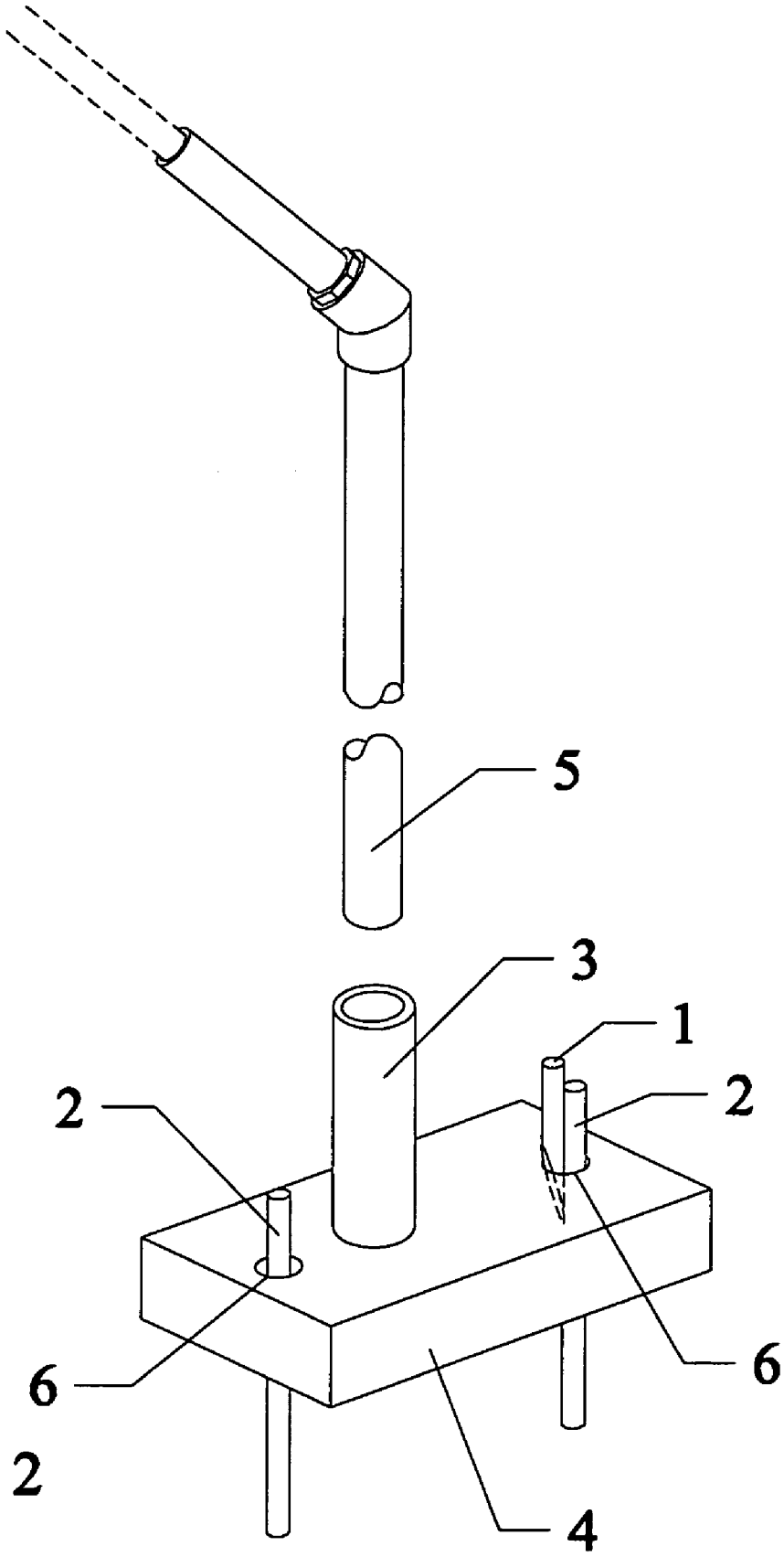
FIG. 2 shows a second oblique view of the invention.
Figure 5:
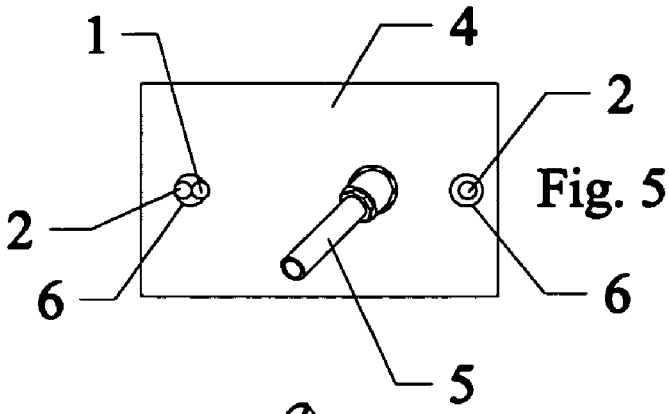
FIG. 5 shows a top-down view of the invention.
Figure 3:
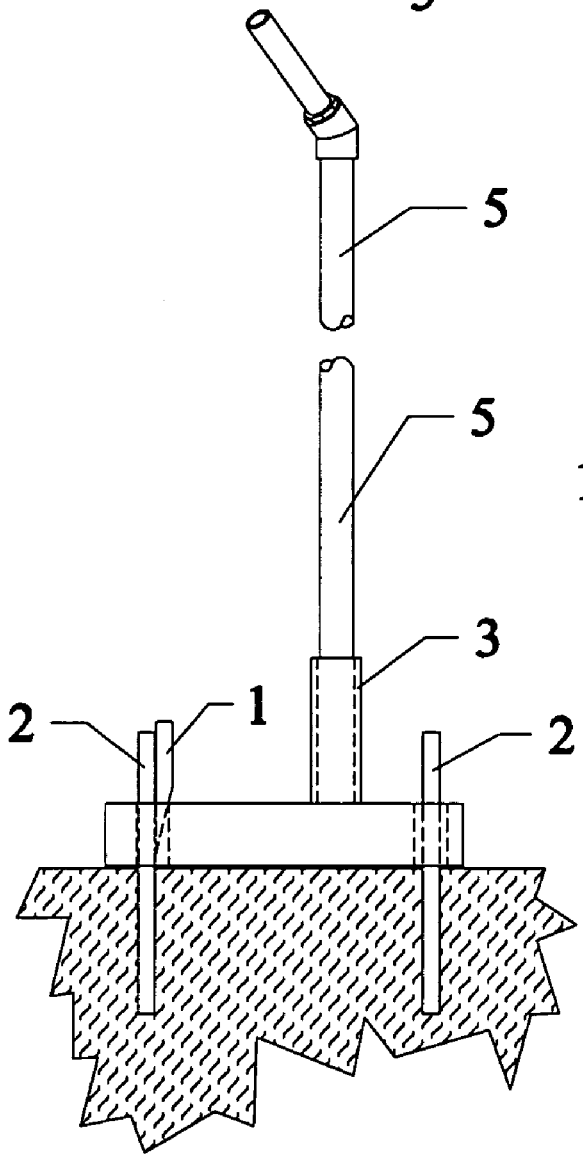
FIG. 3 shows a side view of the invention attached to the ground.
Figure 4:
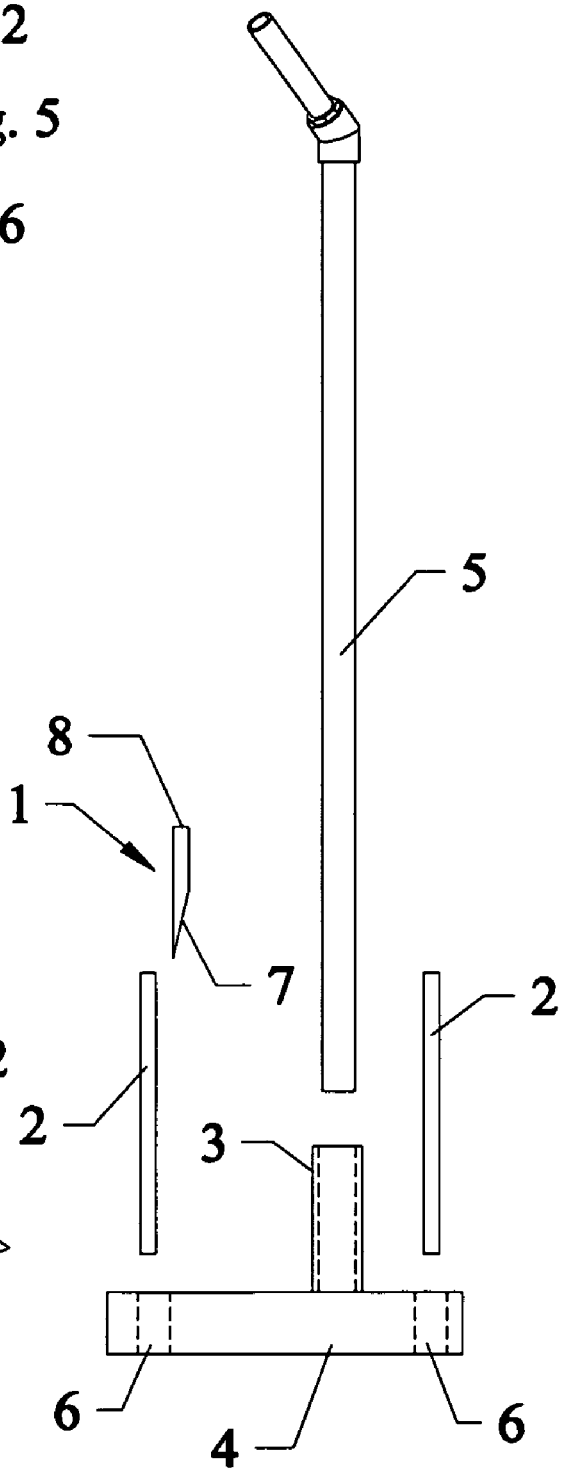
FIG. 4 shows a side view of the invention with its anchoring elements removed.

With reference to FIGS. 1 through 5, pole shaft 5 is removably coupled to the top surface of base 4 by means of coupling 3. FIG. 3 clearly shows that pole shaft 5 is not disposed through base 4. Rather, pole shaft 5 only sits in coupling 3. Coupling 3 is integrally attached to the top surface of base 4 by any means known in the art such as gluing, welding, threading, or forming. Shaft 5 may be of any cross sectional geometry, but typically shaft 5 is cylindrical in geometry with a cross sectional diameter in the range of about one and about three inches. Shaft 5 may include an umbrella or a flag at one end distal to coupling 3.

Coupling 3 may attach to shaft 5 by providing a threaded female socket on coupling 3 that is complementary to a threaded male end of shaft 5. Alternatively, coupling 3 may provide a simple, smooth female socket of inner diameter that is the same as the outer diameter of lower end of smooth shaft 5. In this alternate embodiment, the male end of shaft 5 is also preferably smooth. As a third alternate embodiment in which shaft 5 is not removable, shaft 5, coupling 3, and base 4 may be a single integral unit.

Base 4 has a substantially planar bottom surface that contacts the ground during use of the invention. Base 4 includes at least two cylindrical holes 6 that pass from the top surface of base 4 through to the bottom surface of base 4. The cross-sectional geometry of holes 6 is preferably uniform and circular, but square, hexagonal, or other cross-sectional geometries can be equally employed. Holes 6 are typically in the range of about 0.5 and about 2.0 inches in diameter. Holes 6 are preferably placed on opposed sides of coupling 3 in order to provide maximum stability.

An anchor shaft 2 is driven down through each hole 6 until anchor shaft 2 protrudes from the bottom surface of base 4 and into the ground below as shown in FIG. 3. All anchor shafts 2 are identical and may be made from wood, metal, plastic or other material of suitable strength. The overall geometry of anchor shaft 2 is preferably that of an elongated cylinder with uniform cross-section down the longitudinal axis. Anchor shaft 2 preferably has the same cross-sectional geometry as hole 6, although dissimilar cross-sectional geometry can also be used. The preferred cross-sectional geometry of anchor shaft 2 is circular, but square, hexagonal, or other cross-sectional geometries can be equally employed. More critical is the fact that the cross-sectional diameter of anchor shaft 2 must be less than the cross-sectional diameter of hole 6. In the preferred embodiment, the cross-sectional diameter of anchor shaft 2 is between about 50% and about 75% of the diameter of hole 6.

A key feature of the present invention is the mechanism that firmly attaches the present invention to the ground. In the preferred embodiment, locking pin 1 is an elongated cylinder including a tapered first end 7 and a blunt second end 8. Locking pin 1 preferably has the same cross-sectional geometry as hole 6, although dissimilar cross-sectional geometry can also be used. The preferred cross-sectional geometry of locking pin 1 is circular, but square, hexagonal, or other cross-sectional geometries can be equally employed. More critical is the fact that the cross-sectional diameter of locking pin 1 must be less than the cross-sectional diameter of hole 6. In the preferred embodiment, the cross-sectional diameter of locking pin 1 is between about 25% and about 50% of the diameter of hole 6. The sum of the diameter of an anchor shaft 2 plus the diameter of locking pin 1 should be equal to or slightly greater than the diameter of through hole 6.

To be installed, base 4 of the present invention is first placed upon the ground. Anchor shafts 2 are driven down through holes 6 until they protrude down into the ground. A hammer or mallet may be required to drive anchor shafts 2 into the ground. At this stage of installation, base 4 can slide freely up and down due to the fact that anchor shafts 2 are of a diameter smaller than that of holes 6. Tapered first end 7 of locking pin 1 is inserted into hole 6 adjacent to anchor shaft 2. Locking pin 1 is urged further into hole 6 until base 4, locking pin 1, and anchor shaft 2 are held fast together in an integral assembly. The present invention requires that at least one locking pin 1 be employed. However, more than one anchor shaft 2 could each include a locking pin 1. In an alternate embodiment of the invention, all anchor shafts 2 each include a locking pin 1 for maximum stability.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A support pole comprising:

a pole shaft;

a generally flat base;

a coupling integrally attached to the top surface of said base;

at least two cylindrical holes that pass from the top surface of said base through to the bottom surface of said base;

at least two elongated cylindrical anchor shafts;

at least one elongated cylindrical locking pin;

wherein said pole shaft is removably coupled to the top surface of said base by means of said coupling;

wherein the cross-sectional diameter of each said anchor shaft must be less than the cross-sectional diameter of said hole;

wherein said locking pin includes a tapered first end and a blunt second end;

wherein one said anchor shaft is installed through each said hole until said shaft protrudes from the bottom surface of said base and is adapted to extend down into the ground;

wherein said tapered first end of said locking pin is inserted into one of said holes adjacent to but not encompassing its respective said anchor shaft until said base, said locking pin, and said anchor shaft are held fast together in an integral assembly;

wherein said holes are placed on opposed sides of said coupling in order to provide maximum stability;

wherein the cross-sectional geometry of said holes is circular;

wherein the cross-sectional geometry of said anchor shafts is circular;

wherein the cross-sectional geometry of said locking pin is circular; and wherein the sum of the diameter of said locking pin plus the diameter of the adjacent anchor shaft is equal to or slightly greater than the diameter of said one of said holes.

* * * * *